US007423497B2

(12) United States Patent
Pathak et al.

(10) Patent No.: US 7,423,497 B2
(45) Date of Patent: Sep. 9, 2008

(54) DEVICE FOR COUPLING SUSPENDED STRIPLINE AND NRD GUIDES

(75) Inventors: Nagendra Prasad Pathak, New Delhi (IN); Shiban Kishen Koul, New Delhi (IN); Ananjan Basu, New Delhi (IN)

(73) Assignee: Indian Institute of Technology, New Delhi (IN)

( * ) Notice: Subject to any disclaimer, the term of this patent is extended or adjusted under 35 U.S.C. 154(b) by 0 days.

(21) Appl. No.: 11/239,489

(22) Filed: Sep. 29, 2005

(65) Prior Publication Data

US 2007/0069839 A1 Mar. 29, 2007

(51) Int. Cl.
*H01P 5/107* (2006.01)

(52) U.S. Cl. ..... 333/26; 333/34; 333/248

(58) Field of Classification Search ..... 333/26, 333/248, 34

See application file for complete search history.

(56) References Cited

U.S. PATENT DOCUMENTS

| | | | | | |
|---|---|---|---|---|---|
| 5,473,296 | A | * | 12/1995 | Ishikawa et al. | 333/239 |
| 5,604,469 | A | * | 2/1997 | Ishikawa et al. | 333/1.1 |
| 5,770,989 | A | * | 6/1998 | Ishikawa et al. | 333/248 |
| 5,982,255 | A | * | 11/1999 | Tanizaki et al. | 333/239 |
| 6,512,421 | B1 | * | 1/2003 | Haruta et al. | 333/248 |

* cited by examiner

*Primary Examiner*—Benny Lee
(74) *Attorney, Agent, or Firm*—Allen Dyer Doppelt Milbrath & Gilchrist

(57) ABSTRACT

A hybrid microwave-coupling device is for transmitting signals from non-radiative dielectric (NRD) waveguides to suspended striplines (SSL), and vice-versa. The two transmission lines are placed transversally with a longitudinal side of the NRD guide facing the SSL for conversion of a particular transverse electromagnetic (TEM) mode to a longitudinal section magnetic (LSM) mode.

25 Claims, 8 Drawing Sheets

DEVICE FOR COUPLING SUSPENDED STRIPLINE AND NRD GUIDES

FIELD OF THE INVENTION

The invention relates to an improved device for coupling suspended striplines and NRD guides.

BACKGROUND OF THE INVENTION

A non-radiative dielectric (NRD) guide and a suspended stripline (SSL) are two types of prominent transmission media used for forming millimeter wave integrated circuits. Low loss and low production cost are two main factors that make NRD guides suitable for wireless communication applications at millimeter wave frequencies.

On the other hand, suspended striplines overcome the disadvantage of having to maintain tight dimensional tolerances as in rectangular waveguides, and incorporates the advantageous features of planar technology in the millimeter wave region. The circuits are compatible with beam lead and chip devices, thus offering a potential for construction of passive and active millimeter wave integrated circuits.

Furthermore, suspended striplines permit easy transition to standard rectangular waveguide, and other planar and quasi-planar transmission lines. These include the inverted microstrip, finline and coplanar lines. To utilize the inherent advantages of these two prominent millimeter wave integrated circuit technologies, it is necessary to develop a suitable transition between these two transmission media.

Several transition devices have been described for coupling an NRD guide to a stripline. The concept of a probe type transition between a stripline and an NRD guide was first proposed in 1990 in a paper titled "Analysis and Design of StripLine to NRD Guide Transition" in Asia-Pacific Microwave Conference Proceedings. Other successful efforts to integrate an NRD guide with planar transmission lines, such as a microstrip line, coplanar line or slot line have been reported in 1996. In these reported works, a transition from a microstrip to an NRD guide is proposed and some active and passive components useful for developing hybrid NRD guide systems are reported. However, these papers do not describe a transition from an NRD guide to a suspended stripline (SSL).

WO 02/067366A1 describes a transition from an SMA connector to an NRD guide. Modified SMA connectors are available in the market for connecting a SSL to an SMA connector. However, such transitions provide very poor performance in terms of repeatability of the transmission coefficient. The higher-performance K-connector is not so suitable as it has an impact on the low-cost nature of NRD-guide components.

Also, depending on the tolerances held during manufacturing, SMA connectors have an upper frequency limit which is anywhere from 18 to 26 GHz. This is highly undesirable for microwave communication applications using signals having frequencies higher than 18 GHz. A feed line is inserted between the NRD guide and the SMA connector to transmit TEM waves, and a mode suppressor is added in the middle of a bisected NRD guide for suppressing undesirable modes. This leads to additional hardware requirements in the coupling device, as an SMA connector, a feed line and a mode suppressor are required.

U.S. Pat. No. 5,987,315 describes a diode circuit in a dielectric waveguide device, and a detector and a mixer used within the diode circuit. A diode circuit in the dielectric waveguide is designed to improve the facility with which a circuit substrate is mounted in the dielectric waveguide, and to make matching between a dielectric waveguide and a diode easier.

A conductor pattern (forming a stripline) is disposed so as to intersect a pair of dielectric strips substantially perpendicularly to the same, and two filter circuits are fabricated on opposite sides of the dielectric strips, thereby forming a resonant circuit. However, the device is used specifically for diode devices and requires suspending a conductor pattern on a circuit substrate between conductor plates by passing the circuit substrate through the dielectric strip to form a suspended stripline.

The device does not provide proper protection for the circuit substrate, which is left suspended through the dielectric strip. Also, the device requires extra filters on opposite ends and extra diodes to prevent propagation of undesirable electromagnetic wave modes through the suspended stripline. Hence, extra hardware is required. The device also does not provide proper protection against external electromagnetic wave sources.

SUMMARY OF THE INVENTION

There is a need for an improved coupling device which may transmit signals from an NRD guide to a suspended stripline, and vice-versa. There is also a need for a coupling device which does not require additional circuitry/devices for propagation of a desired Transverse Electromagnetic mode (TEM) through the device. Also, there is a need for a coupling device which provides protection against external electromagnetic wave sources.

To address the drawbacks of the prior art, the object of the present is to provide an improved device for coupling suspended striplines and NRD guides.

Another object of the present invention is to provide a coupling device that does not require additional protection circuitry for undesired TEM propagation.

Yet another object or the present invention is to provide a coupling device that provides protection against external electromagnetic wave sources.

To achieve the aforesaid objects, the present invention provides an improved device for coupling suspended striplines and NRD guides comprising top and bottom conductor plates that are parallel to one another, at least one dielectric strip disposed between the top and bottom conductor plates to form one or more non-radiative dielectric (NRD) waveguides, and at least one conductor strip suspended between the top and bottom conductor plates to form one or more suspended striplines. Each suspended stripline may be transversally located with respect to a longitudinal side of the non-radiative dielectric waveguide at a predetermined distance for coupling energy therebetween. At least one of the dielectric strips or the suspended stripline may be coupled to signals from an external transmission media.

BRIEF DESCRIPTION OF THE DRAWINGS

The present invention will now be described with reference to the accompanying drawings.

DETAILED DESCRIPTION OF THE PREFERRED EMBODIMENT

Figure 1B:
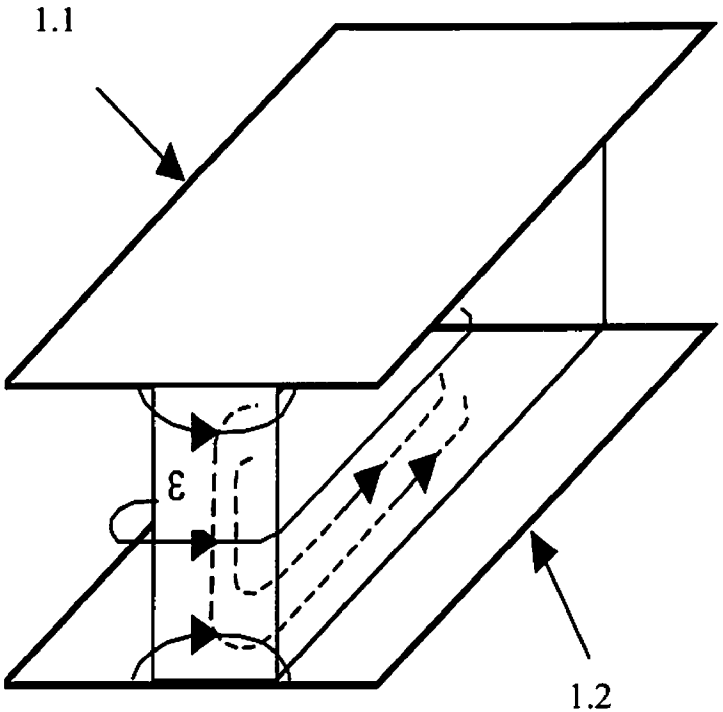
FIG. 1B illustrates the dominant mode field configuration of an NRD guide according to the present invention.
Figure 1A:
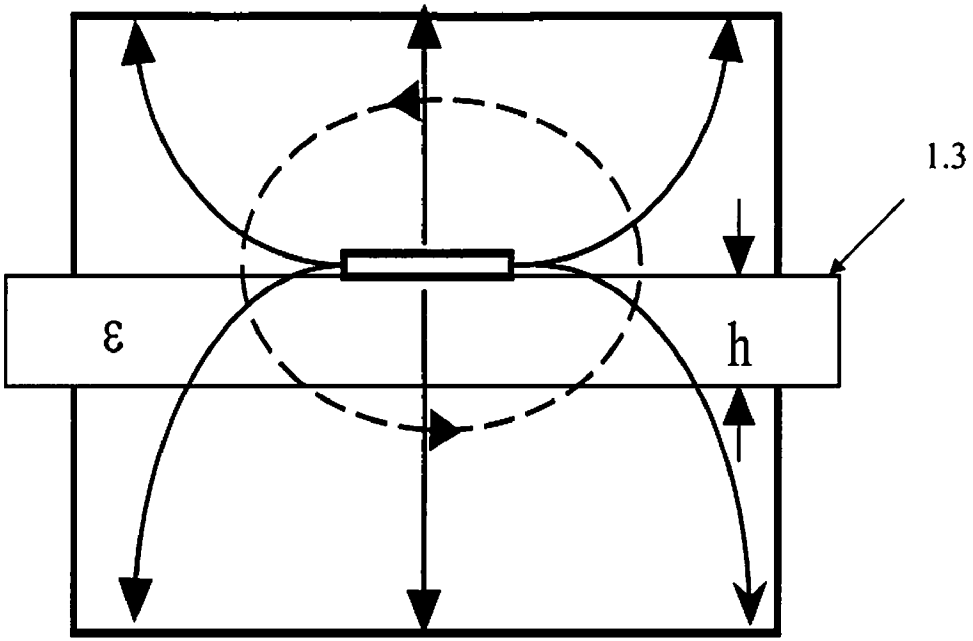
FIG. 1A illustrates the dominant mode field configuration of a suspended stripline according to the present invention.

FIGS. 1A and 1B respectively show a cross-sectional view of the suspended stripline and a longitudinal view of the NRD guide along with the electric and magnetic field distributions for the desired modes. The suspended stripline supports a quasi-TEM mode whose field distribution is shown in FIG. 1A. The NRD guide supports two modes, $LSE_{11}$ and $LSM_{11}$. The $LSM_{11}$ mode is a desirable, lossless mode and its electric field is parallel to the metal plates (1.1 and 1.2) while magnetic field lines are parallel to the dielectric-air interface (1.3) as shown in FIG. 1B.

On careful examination of the field configurations of these two structures, it is observed that if the front side of the SSL is placed on the longitudinal side of the NRD guide, its magnetic field lines are parallel to the magnetic field lines of the NRD guide. Thus, if properly aligned, it is possible to couple electromagnetic energy from a quasi-TEM mode of the SSL to an $LSM_{11}$ mode of the NRD guide. This field-matching concept provides a hybrid transition in accordance with the present invention. Coupling of energy depends on several parameters such as the relative positions of the open ends of the NRD guide and the SSL, a dielectric constant of the SSL substrate, and probe shapes, etc.

In a preferred embodiment, the coupling from the NRD guide to the suspended stripline can be developed using a probe type structure. Two possible ways of forming a back-to-back NRD guide to a suspended stripline transition (for testing a back-to-back transition, as opposed to a single one, is required) are described where: (a) a suspended stripline probe is located at the input and output side of the NRD guide, and (b) an NRD guide is located at the input and output side of the suspended stripline.

The coupling structure developed using the first topology is referred to as an SSL-NRD-SSL coupler. The coupling structure developed using the second topology is referred to as an NRD-SSL-NRD coupler. Hence, depending on the application and external transmission media, a coupling device can be fabricated for case (a) or case (b). These two differ only in the way they are connected to the external media, and not in the behavior of the actual SSL-NRD transitions.

Figure 2:
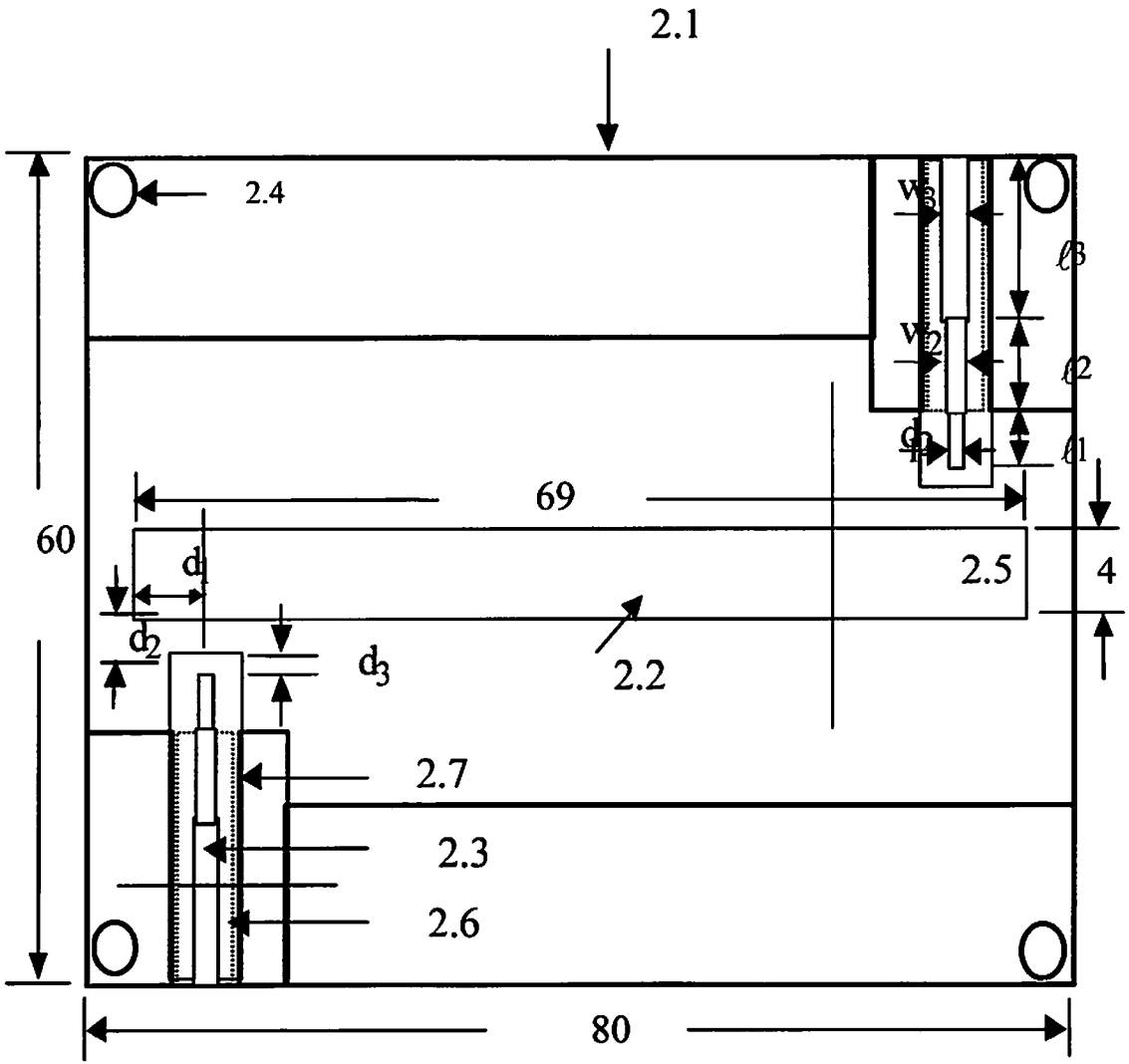
FIG. 2 illustrates the geometry for an embodiment of SSL-NRD-SSL transitions in accordance with the present invention.

FIG. 2 shows the geometry including dimensions (in millimeters) of an SSL-NRD-SSL coupler, but such dimensions are not described in detail. The coupling device comprises two metal plates (2.1), a dielectric (TEFLON or polytetrafluoroethylene) strip (2.2) and an SSL probe (2.3). The two metal plates (2.1) are designed so as to form an enclosure/housing for the dielectric strip (2.2), the SSL probes (2.3) and threaded holes (2.4).

A channel (2.5) is machined in the bottom and top ground metal plates of the housing to accommodate each dielectric strip (2.2) and the SSL probes (2.3). The channel (2.5) for the dielectric strip (2.2) is created so as to be essentially parallel to the edges of the housing, and the channels (2.6) for the SSL probes (2.3) are created essentially perpendicular to the dielectric strip channel (2.5).

Additionally, the SSL probe channels (2.6) are made so that they face the longitudinal side of the dielectric strip channel (2.5) at an optimized distance $d_1$ between the center of the SSL probe (2.3) and edge of the NRD guide (2.2). Similarly, a distance $d_2$ between the SSL probe (2.3) and a side of the NRD guide (2.2) is optimized to minimize the insertion loss between the two media. The distance $d_3$ between the edge of the dielectric substrate (2.7) of the probe and the edge of the SSL strip conductor of the probe is also optimized for the same purpose. Besides this, probe (2.3) dimensions ($l_1$, $l_2$, $w_1$, $w_2$, $w_3$ and $l_3$) are optimized for minimizing insertion loss. Threaded holes are used for inserting screws for attaching the two metal plates for forming the housing.

The metal housing used in the design of this transition is shown in FIGS. 3A-3F along with the dimensions (in millimeters) used in the present embodiment, but such dimensions are not described in detail. The housing comprises two metal plates (3.1 and 3.2) with channels for dielectric strips (3.3) and conductor strips (3.4) precisely located to form enclosures for forming the suspended striplines and the NRD guides, threaded holes (3.6) and screws for the threaded holes, as best referenced in FIGS. 3A, 3D and 3E.

Figures 3A, 3B, 3C, 3D, 3E, 3F:
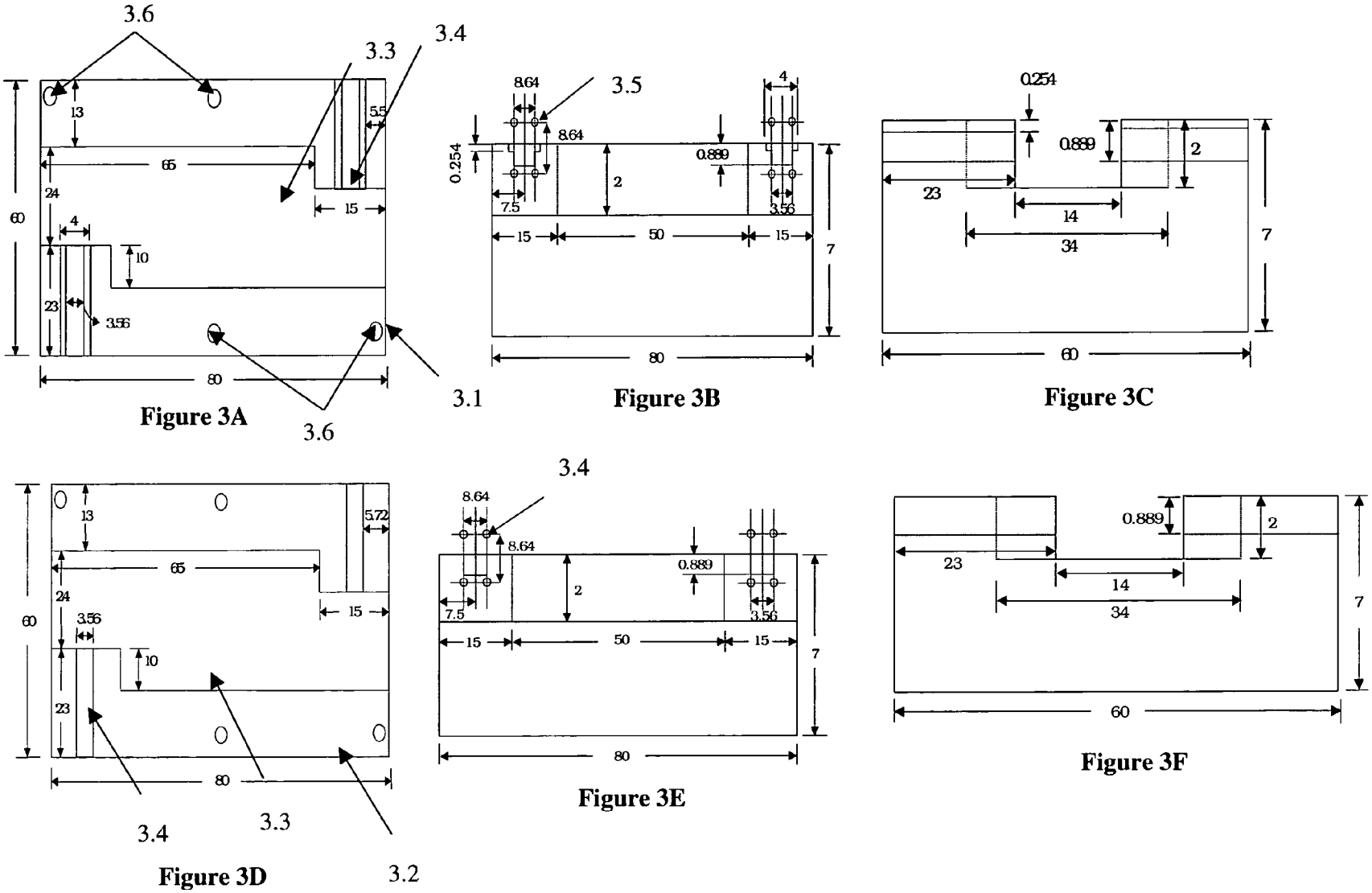
FIGS. 3A-3F illustrate dimensions of a metal housing used in an SSL-NRD-SSL coupler (all dimensions are in mm) in accordance with the present invention.

A two-level channel (3.5) as referenced in FIG. 3(B) is machined for the stripline probe channel in the bottom metal plate (3.1). The upper level channel of the two-level channel (3.5) is used to place the thin RT-DURIOD or polytetrafluoroethylene and microfiber glass substrate carrying the printed probe, and the lower level channel of the two-level channel (3.5) forms the bottom air-gap for the suspended stripline.

Creating the channel in the top metal plate (3.2) for the stripline probe channel (3.3) is easy as it requires machining a single channel in the metal plate (3.2), and it does not pose any complexity to the geometry of the NRD guide. The channels in the top and bottom plates (3.1 and 3.2) for the NRD guide are placed precisely to form a single channel holding the dielectric strip in side grooves. The dimensions of the metal housing including the channels are optimized using a Finite Element Method (FEM) simulator.

In the preferred embodiment, the dimensions of the SSL channels (3.3) are selected so that cutoff frequencies of higher order modes are much above the operating frequency, and support only a quasi-TEM mode of propagation. The dimensions are selected according to the cutoff frequency formula available in the literature. The TEFLON NRD guide used in the transition directs energy from the input port to the output port. The threaded holes (3.6) and the screws are used to attach the top and bottom plates (3.1 and 3.2) to form a single housing.

Figure 4:
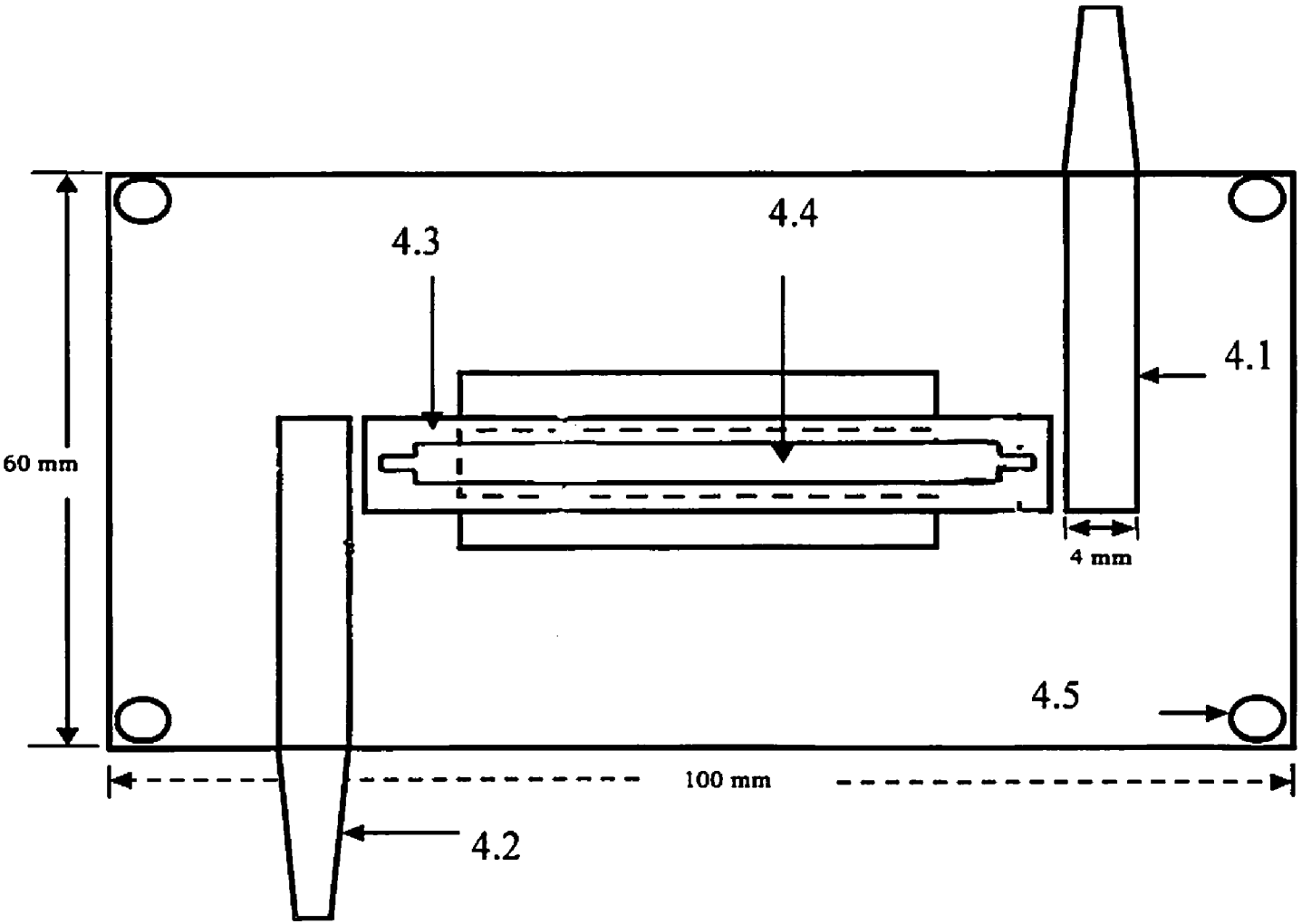
FIG. 4 illustrates the geometry for an embodiment of an NRD-SSL-NRD transition in accordance with the present invention.
Figure 5A:
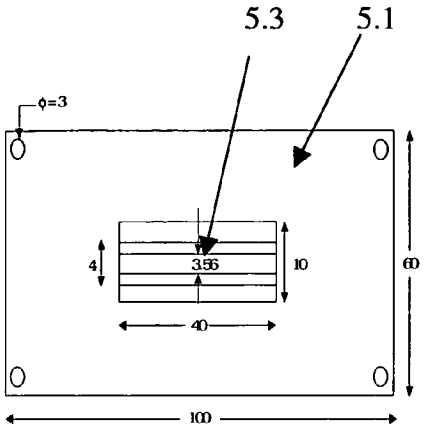
FIGS. 5A-5F illustrate dimensions of a metal housing used in an NRD-SSL-NRD coupler (all dimensions are in mm) in accordance with the present invention.
Figure 5B:
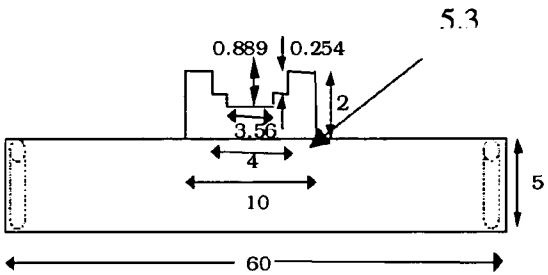
Figure 5C:
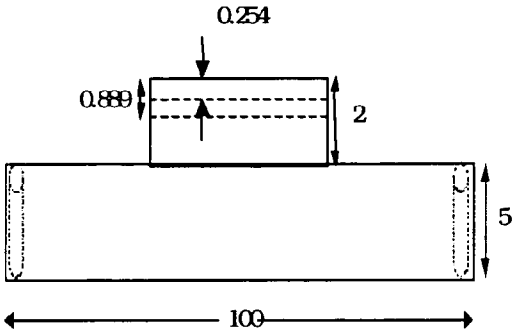
Figure 5D:
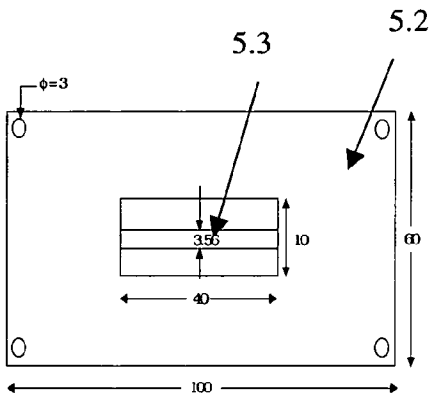
Figure 5E:
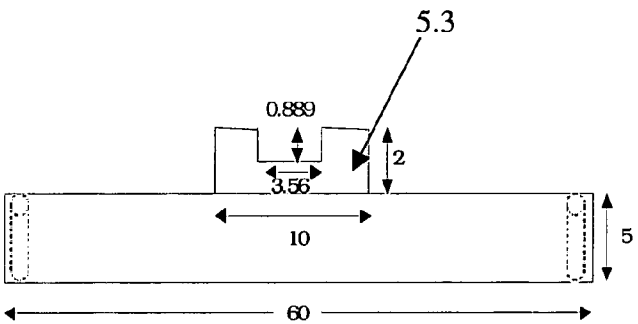
Figure 5F:
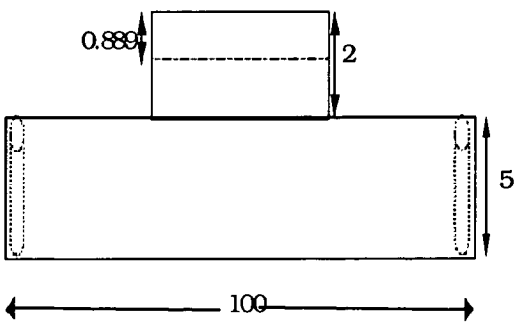

The dual geometry including dimensions (in millimeters) of the second embodiment with the NRD-SSL-NRD coupler is shown in FIG. 4, but such dimensions are not described in detail. NRD guides (4.1) are used at the input and output ports for connecting the device to external transmission media using tapered transitions (4.2). A single suspended stripline (4.3) is used in the middle for coupling energy from the input to the output of the NRD guides.

Different patterns may be used in the SSL conductor strip (4.4) to form different microwave circuits. Hence, the device may be used for forming microwave circuitry harder to realize using simple NRD guide based microwave circuits. Threaded holes (4.5) are provided for attaching the metal plates to form the housing.

The drawing of the metal housing used in the development of this coupler along with its dimensions (in millimeters) is given in FIGS. 5A-5F, but such dimensions are not described in detail. A channel (5.3) is created in the ground plates (5.1 and 5.2) parallel to the edges to accommodate the suspended stripline, as referenced in FIGS. 5A, 5B, 5D and 5E. Channels for input and output lines are for the NRD guides that are extended so that the longitudinal side of the NRD guides is essentially perpendicular to the front of the SSL.

A two-level channel (5.3) is formed in the bottom plate (5.1) similar to the channel in first embodiment. The distances $d_1$, $d_2$ and $d_3$ as referenced in FIG. 2 are optimized to minimize the insertion loss and to allow a quasi-TEM mode of propagation. The physical dimensions of the final optimized coupler are: bottom metal plate (80 mm×60 mm×7 mm), top metal plate (80 mm×60 mm×7 mm), SSL channel (23 mm×3.56 mm×1.78 mm), TEFLON strip (70.0 mm×4 mm×4 mm), RT-DUROID (27.9 mm×4 mm×0.254 mm), stepped impedance probe ($l_1$=19.0 mm, $w_1$=2.0 mm, $l_2$=6.3 mm, $w_2$=1.5 mm, $l_3$=2.55 mm, $w_3$=1.0 mm as also referenced in FIG. 2), 50 ohm line probe (l=27.9 mm, w=2.0 mm although not illustrated in the figures), distance $d_1$=2.0 mm, distance $d_2$=0.1 mm, and distance $d_3$=0.05 mm.

Figure 6:
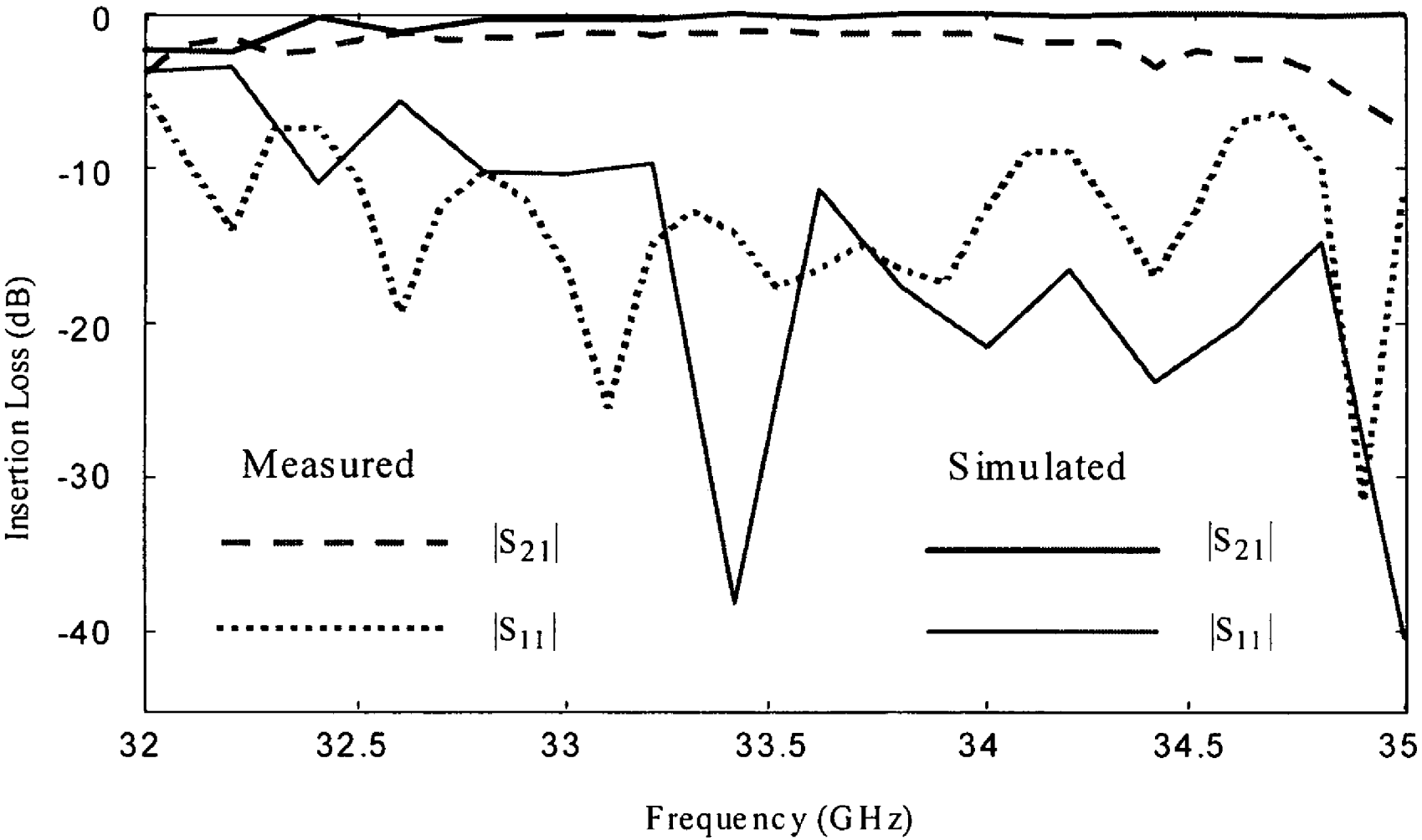
FIG. 6 is a graph illustrating measured and simulated characteristics of an SSL-NRD-SSL transition in accordance with the present invention.

FIG. 6 shows the measured response of the back-to-back SSL-NRD-SSL coupler. The simulated response is superimposed on this plot for comparison. Good similarities are observed between the simulated and experimental results. It is evident that the measured bandwidth is smaller than the simulated values. The reason for this is the fact that two extra transitions from the SSL to the K-connector used for testing at either end are not considered in the simulation. A flat response of the K-connector transition at frequencies above 35 GHz is difficult to achieve. Due to this reason, the overall measured transmission loss of the transition assembly increases significantly above 35 GHz.

Figure 7:
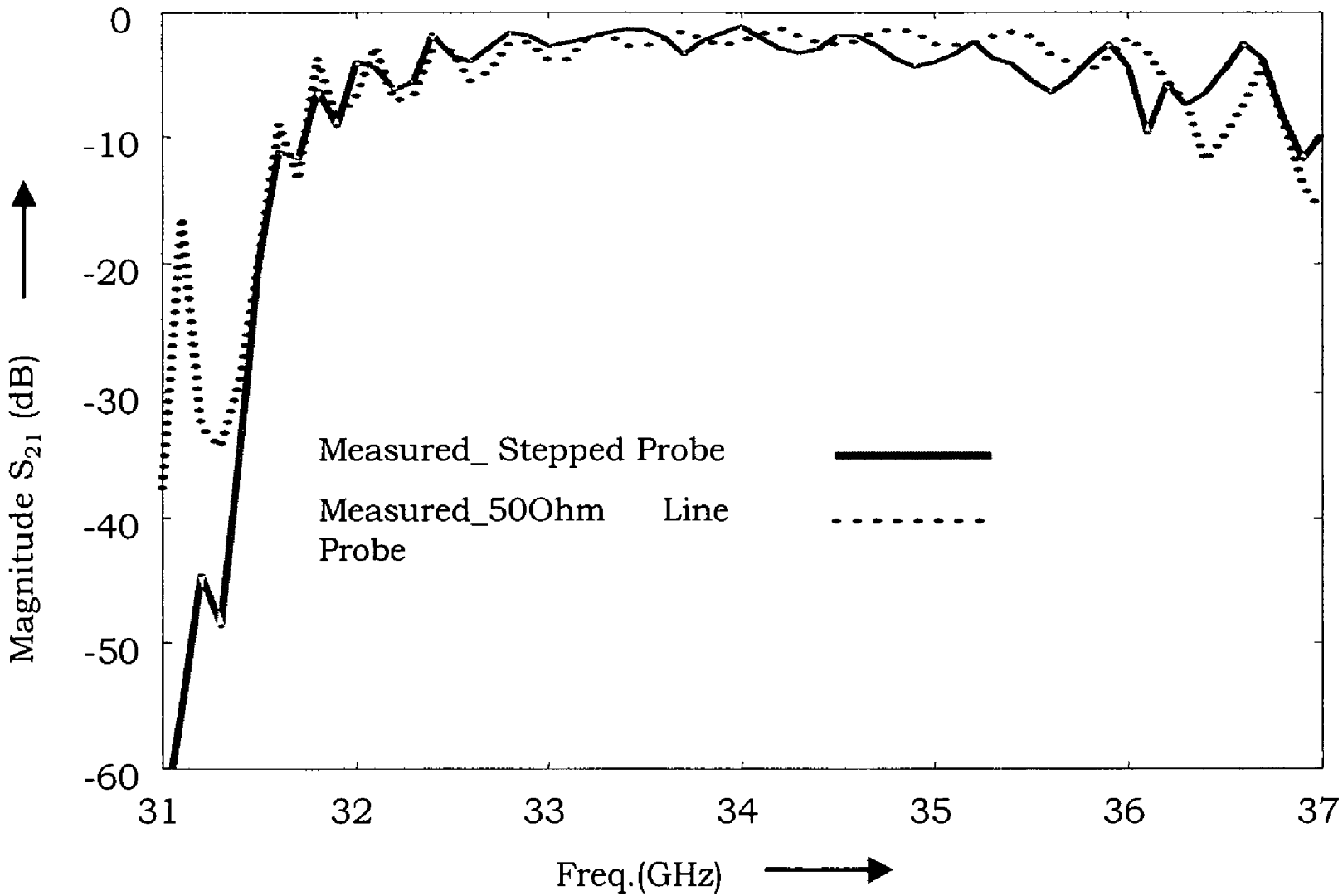
FIG. 7 is a graph illustrating measured characteristics of an SSL-NRD-SSL transition for two different SSL probe shapes in accordance with the present invention.

FIG. 7 shows the measured response of the transition for two different SSL probe shapes. The response is practically identical although simulations predict that a slight improvement with stepped probe is possible.

The problem of an increased measured loss at the high frequency end in an SSL-NRD-SSL coupler can be taken care of by using the dual geometry, i.e., an NRD-SSL-NRD coupler. Since a rectangular wave-guide to an NRD guide tapered transition (used for test purposes) works fairly well from 32 GHz onwards, the problem of bandwidth contraction is not observed while making measurements.

Figure 8:
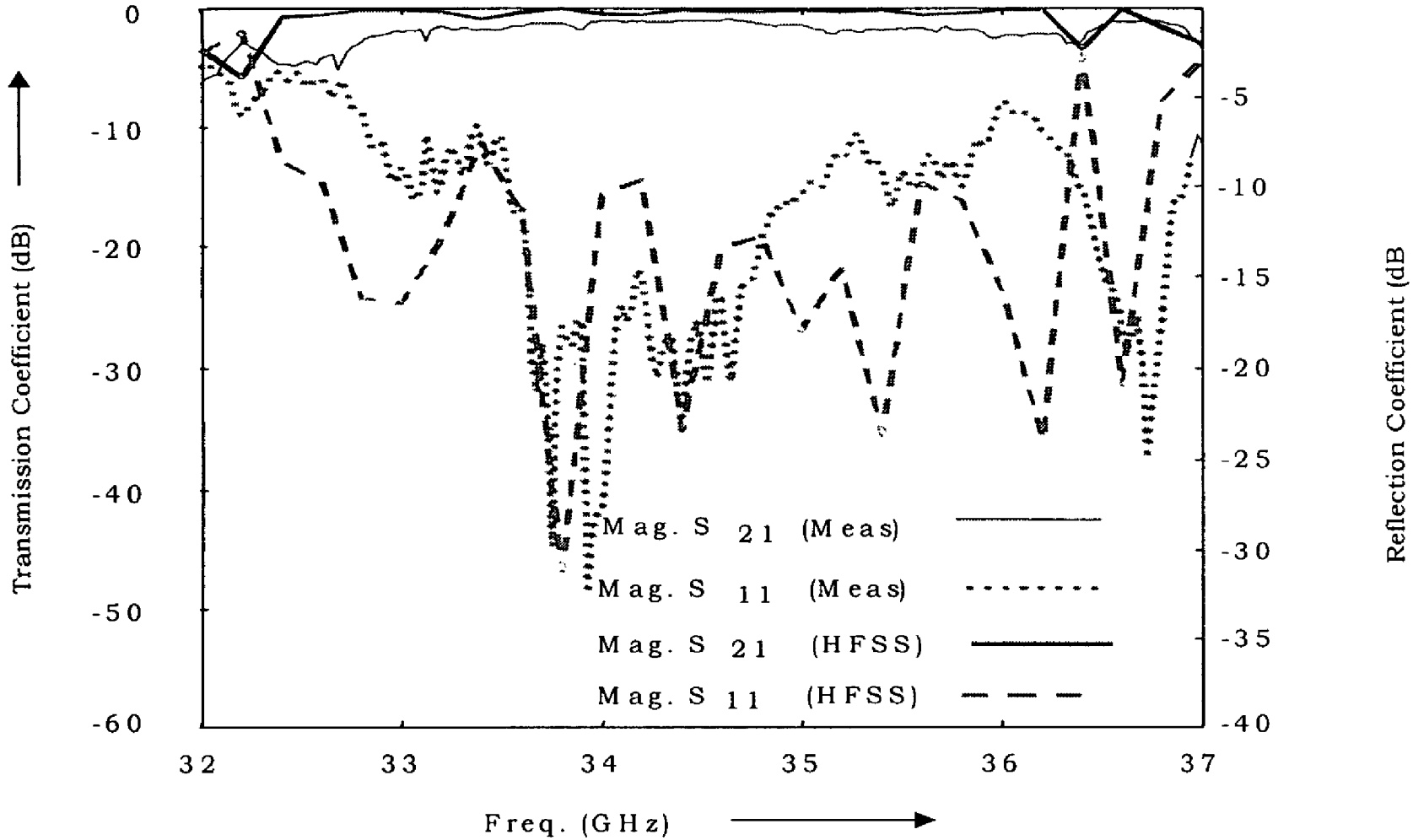
FIG. 8 is a graph illustrating measured and simulated characteristics of an NRD-SSL-NRD transition in accordance with the present invention.

Keeping this in mind, the WG-NRD-SSL-NRD-WG transition is simulated. The optimized probe (should be same as the first type) is a stepped impedance type, which gives low insertion loss over a wide bandwidth. The dimensions used in the fabrication of this transition structure are: bottom metal plate (100 mm×60 mm×5 mm), top metal plate (100 mm×60 mm×5 mm), SSL channel (40 mm×3.56 mm×1.78 mm), substrate (RT-DUROID, h=0.254 mm as referenced in FIG. 1A), S=2.22), probe dimensions ($l_1$=46.9 mm, $l_2$=1.5 mm, $w_1$=2.5 mm, $w_2$=1.5 mm, $l_3$=0.05 mm as referenced in FIG. 2) and strip to probe spacing ($d_2$=0.1 mm, $d_1$=2.0 mm as also referenced in FIG. 2). The measured and simulated insertion loss of this coupler is shown in FIG. 8. As observed, this dual coupling structure offers a sufficiently wide bandwidth (4 GHz) with low insertion loss.

All documents cited in the description are incorporated herein by reference. The present invention is not to be limited in scope by the specific embodiments and examples that are intended as illustrations of a number of aspects of the invention, and any embodiments that are functionally equivalent are within the scope of the invention. Those skilled in the art will know, or be able to ascertain using no more than routine experimentation, many equivalents to the specific embodiments of the invention described herein. These and all other equivalents are intended to be encompassed by the following claims.

We claim:

1. A coupling device comprising:

a non-radiative dielectric (NRD) electromagnetic waveguide comprising spaced apart top and bottom electrically conductive layers, and a dielectric strip therebetween having a tapered transition for coupling with an external transmission source; and a suspended stripline (SSL) electromagnetic waveguide being coupled to said NRD electromagnetic waveguide so that electromagnetic energy transfers therebetween, said SSL electromagnetic waveguide comprising an electrically conductive strip being configured as a stepped impedance probe for providing the coupling to said NRD electromagnetic waveguide, an electrically conductive housing surrounding said electrically conductive strip, and at least one dielectric member suspending said electrically conductive strip within said electrically conductive housing;

said electrically conductive strip of said SSL electromagnetic waveguide and said dielectric strip of said NRD electromagnetic waveguide being physically separated from each other for reducing insertion loss.

2. A coupling device as in claim 1, wherein said top and bottom electrically conductive layers have at least one stripline channel therein positioned surrounding said electrically conductive strip of said SSL electromagnetic waveguide.

3. A coupling device as in claim 2, wherein the at least one stripline channel includes in said bottom electrically conductive layer the following:

an upper level channel for holding said at least one dielectric member of said SSL electromagnetic waveguide; and a lower level channel for forming a bottom air-gap below said at least one dielectric member of said SSL electromagnetic waveguide.

4. A coupling device as in claim 2, wherein the at least one stripline channel includes in said top electrically conductive layer a channel for forming a top air-gap above said at least one dielectric member of said SSL electromagnetic waveguide.

5. A coupling device as in claim 2, wherein dimensions of the at least one suspended stripline are based on providing a reduced insertion loss.

6. A coupling device as in claim 1, wherein said dielectric strip of said NRD electromagnetic waveguide comprises polytetrafluoroethylene.

7. A coupling device as in claim 1, wherein said top and bottom electrically conductive layers have at least one NRD dielectric channel for receiving therein said dielectric strip of said NRD electromagnetic waveguide.

8. A coupling device as in claim 1, wherein each of said top and bottom electrically conductive layers comprises metal.

9. A coupling device as in claim 1, wherein said electrically conductive strip of said SSL electromagnetic waveguide is transversally located a predetermined distance from said dielectric strip of said NRD electromagnetic waveguide.

10. A coupling device as in claim 1, wherein said top and bottom electrically conductive layers include respective fastener receiving openings therein.

11. A coupling device as in claim 1, wherein said SSL electromagnetic waveguide is configured for coupling with an external transmission source.

12. A coupling device comprising:

a non-radiative dielectric (NRD) electromagnetic waveguide comprising spaced apart top and bottom electrically conductive layers, and a dielectric strip therebetween having a tapered transition for coupling with an external transmission source; and a suspended stripline (SSL) electromagnetic waveguide being coupled to said NRD electromagnetic waveguide so that electromagnetic energy transfers therebetween, said SSL electromagnetic waveguide comprising an electrically conductive strip, an electrically conductive housing surrounding said electrically conductive strip, and at least one dielectric member suspending said electrically conductive strip within said electrically conductive housing.

13. A coupling device as in claim 12, wherein said top and bottom electrically conductive layers have at least one NRD dielectric channel for receiving therein said dielectric strip of said NRD electromagnetic waveguide.

14. A coupling device as in claim 12, wherein said electrically conductive strip of said SSL electromagnetic waveguide is transversally located a predetermined distance from said dielectric strip of said NRD electromagnetic waveguide.

15. A coupling device as in claim 12, wherein said top and bottom electrically conductive layers include respective fastener receiving openings therein.

16. A coupling device as in claim 12, wherein said top and bottom electrically conductive layers have at least one stripline channel therein positioned surrounding said electrically conductive strip of said SSL electromagnetic waveguide.

17. A coupling device comprising:

a non-radiative dielectric (NRD) electromagnetic waveguide comprising spaced apart top and bottom electrically conductive layers, and a dielectric strip therebetween; and a suspended stripline (SSL) electromagnetic waveguide being coupled to said NRD electromagnetic waveguide so that electromagnetic energy transfers therebetween, said SSL electromagnetic waveguide comprising an electrically conductive strip being configured as a stepped impedance probe for providing the coupling to said NRD electromagnetic waveguide, an electrically conductive housing surrounding said electrically conductive strip, and at least one dielectric member suspending said electrically conductive strip within said electrically conductive housing.

18. A coupling device as in claim 17, wherein said top and bottom electrically conductive layers have at least one NRD dielectric channel for receiving therein said dielectric strip of said NRD electromagnetic waveguide.

19. A coupling device as in claim 17, wherein said electrically conductive strip of said SSL electromagnetic waveguide is transversally located a predetermined distance from said dielectric strip of said NRD electromagnetic waveguide.

20. A coupling device as in claim 17, wherein said top and bottom electrically conductive layers include respective fastener receiving openings therein.

21. A coupling device as in claim 17, wherein said top and bottom electrically conductive layers have at least one stripline channel therein positioned surrounding said electrically conductive strip of said SSL electromagnetic waveguide.

22. A coupling device comprising:

a non-radiative dielectric (NRD) electromagnetic waveguide comprising spaced apart top and bottom electrically conductive layers, and a dielectric strip therebetween; and a suspended stripline (SSL) electromagnetic waveguide being coupled to said NRD electromagnetic waveguide so that electromagnetic energy transfers therebetween, said SSL electromagnetic waveguide comprising an electrically conductive strip, an electrically conductive housing surrounding said electrically conductive strip, and at least one dielectric member comprising polytetrafluoroethylene and microfiber glass and suspending said electrically conductive strip within said electrically conductive housing.

23. A coupling device as in claim 22, wherein said top and bottom electrically conductive layers have at least one NRD dielectric channel for receiving therein said dielectric strip of said NRD electromagnetic waveguide.

24. A coupling device as in claim 22, wherein said electrically conductive strip of said SSL electromagnetic waveguide is transversally located a predetermined distance from said dielectric strip of said NRD electromagnetic waveguide; and wherein said top and bottom electrically conductive layers include respective fastener receiving openings therein.

25. A coupling device as in claim 22, wherein said top and bottom electrically conductive layers have at least one stripline channel therein positioned surrounding said electrically conductive strip of said SSL electromagnetic waveguide.

* * * * *